US011109693B2

(12) United States Patent
Xu

(10) Patent No.: US 11,109,693 B2
(45) Date of Patent: Sep. 7, 2021

(54) SHELF LIGHTING SYSTEM, A LAMINATE EQUIPPED WITH THE LIGHTING SYSTEM AND A SHELF THERETO

(71) Applicants: Self Electronics Co., Ltd., Zhejiang (CN); Wanjiong Lin, Zhejiang (CN); Self electronics USA Corporation, Norcross, GA (US)

(72) Inventor: Le Xu, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/918,703

(22) Filed: Jul. 1, 2020

(65) Prior Publication Data

US 2021/0145192 A1 May 20, 2021

(30) Foreign Application Priority Data

Nov. 20, 2019 (CN) ..... 201911138130.0

(51) Int. Cl.

| | |
|---|---|
| ***A47F 11/10*** | (2006.01) |
| ***F21S 4/20*** | (2016.01) |
| ***F21V 21/096*** | (2006.01) |
| ***F21V 21/35*** | (2006.01) |
| ***F21V 23/06*** | (2006.01) |
| ***H01R 33/88*** | (2006.01) |

(Continued)

(52) U.S. Cl.

CPC ..... *A47F 11/10* (2013.01); *F21S 4/20* (2016.01); *F21V 21/096* (2013.01); *F21V 21/35* (2013.01); *F21V 23/06* (2013.01); *H01R 33/88* (2013.01); *H01R 33/94* (2013.01); *F21Y 2115/10* (2016.08)

(58) Field of Classification Search

CPC ..... A47F 11/10; A47F 5/0043; A47F 5/103; A47F 5/00; A47F 5/10; H01R 33/88; H01R 33/94; H01R 13/245; H01R 13/26; H01R 13/2421; H01R 25/145; F21V 21/35; F21V 21/096; F21V 23/06; F21V 33/0012; F21S 4/20; F21S 4/28; F21Y 2115/10; F21W 2131/405; A47B 96/061; A47B 96/1408; A47B 2220/0077

See application file for complete search history.

(56) References Cited

U.S. PATENT DOCUMENTS 6,270,232 B1 * 8/2001 Shemitz ..... A47F 11/10 362/125
7,165,863 B1 * 1/2007 Thomas ..... F21V 15/01 362/219

(Continued)

FOREIGN PATENT DOCUMENTS

CN 110459925 A * 11/2019 ..... H02G 11/006
CN 210383391 U * 4/2020

*Primary Examiner* — Rajarshi Chakraborty
*Assistant Examiner* — Glenn D Zimmerman
(74) *Attorney, Agent, or Firm* — Wang Law Firm, Inc.

(57) ABSTRACT

A shelf lighting system has a lighting module and a power taking module, the power taking module has a power taking head, a strip-shaped conductive member, and a plug connector. The shelf lighting system integrates the power taking module of the shelf lighting system onto the support arm of the shelf, so that the power taking module can be installed simultaneously with installation of the laminate, which simplifies the entire lamp installation process and improves the installation efficiency.

14 Claims, 13 Drawing Sheets

(51) Int. Cl.
*H01R 33/94* (2006.01)
*F21Y 115/10* (2016.01)

(56) References Cited

U.S. PATENT DOCUMENTS

| | | | | |
|---|---|---|---|---|
| 10,935,221 | B1 * | 3/2021 | Tirosh | F21V 23/023 |
| 2012/0230018 | A1 * | 9/2012 | Wiemer | F21V 23/06 362/133 |
| 2013/0016500 | A1 * | 1/2013 | Tress | F21S 4/28 362/133 |
| 2015/0182038 | A1 * | 7/2015 | Wiemer | A47F 3/001 108/23 |
| 2015/0289681 | A1 * | 10/2015 | Sun | A47F 5/103 108/23 |
| 2018/0255944 | A1 * | 9/2018 | Ford | A47F 5/0043 |
| 2021/0007483 | A1 * | 1/2021 | Zheng | H02G 11/006 |

* cited by examiner

SHELF LIGHTING SYSTEM, A LAMINATE EQUIPPED WITH THE LIGHTING SYSTEM AND A SHELF THERETO

RELATED APPLICATION

This application claims priority to a Chinese Patent Application No. CN 201911138130.0, filed on Nov. 20, 2019.

FIELD OF THE TECHNOLOGY

The present invention relates to the field of lighting technology, with particular emphasis on a shelf lighting system, a laminate equipped with the lighting system and a shelf thereto.

BACKGROUND OF THE INVENTION

Shelves are used in a wide range of areas, such as shopping malls, logistics warehouses, factory warehouses, etc., where shelves are needed to store items that are being sold or not in immediate use. During the use of these shelves, lighting is necessary, especially the shelves used in shopping malls, which have particularly high requirements for lighting, such as space saving, safety, convenient assembly, beautiful, etc., the shelf generally includes a backplane (which can be canceled), vertical column and laminate, the laminate includes the support arm for mounting on the vertical column.

In the prior art, the power supply for powering the LED lamps installed on the irradiation surface of the shelf is generally installed on the backlight surface of the shelf. Therefore, LED lamps need to be connected to the power supply by threading wires or winding wires from the irradiation surface of the shelf to reach the backlight surface of the shelf. This kind of power supply setting method in the prior art leads to inconvenience in tying up wires, more wiring and messy, which is not conducive to maintenance and aesthetics and affects the effect of commodity irradiation.

BRIEF SUMMARY OF THE INVENTION

In view of this, the present invention provides a shelf lighting system to solve the above technical problems.

a shelf lighting system comprises a lighting module and a power taking module, characterized in that the lighting module is disposed on the lower surface of a laminate near the outer edge of the laminate. The power taking module comprises:

the power taking head, fixed on the inner side of the support arm near the shelf pillar, and connected with the power supply rail on the shelf pillar to achieve electrical connection;

a strip-shaped conductive member, located inside the support arm, and one end is electrically connected to the power taking head;

a plug connector, fixed at one end of the inner side of the support arm close to the outer edge of the laminate, and electrically connected to the other end of the strip-shaped conductive member and providing power for the lighting module.

Advantageously, the strip-shaped conductive member comprises a strip-shaped housing and a lead wire disposed in the strip-shaped housing.

Advantageously, the strip-shaped housing is provided with a fastening hole for fixing.

Advantageously, the power taking head comprises:

a first installation seat, fixedly connected to one end of the strip-shaped housing;

a first installation cavity, which is provided on the first installation seat and communicates with the strip-shaped housing;

a first conductive circuit board, disposed in the first installation cavity, and electrically connected to the lead wire;

and an elastic contact, telescopically arranged on the first installation seat, and one end extends into the first installation cavity and the first conductive circuit board, and the other end extends out of the first installation cavity.

Advantageously, the direction of expansion and contraction of the elastic contact is perpendicular to the plane where the inside of the support arm lies.

Advantageously, the first installation seat is provided with a mounting hole for accommodating an elastic contact, the elastic contact comprises an elastic column arranged in the mounting hole and an conductive springs arranged between the first conductive circuit board and the elastic column.

Advantageously, the plug connector comprises:

a second installation seat, fixedly connected to the other end of the strip-shaped housing, and being with a plug that protrudes outward;

a second installation cavity, which is provided on the second installation seat and communicates with the strip-shaped housing;

a second conductive circuit board, disposed in the second installation cavity, and electrically connected to the lead wire;

and a strip-shaped contact piece, fixed on the plug, and one end extends into the second installation cavity and electrically connected to the second conductive circuit board, and the other end is bent outward to form elastic contacts.

Advantageously, the insertion direction of the plug is perpendicular to the plane where the inside of the support arm is located.

Advantageously, the plug is oriented towards the shelf pillar and the insertion direction is parallel to the plane where the support arm is located.

Advantageously, the plug is vertically downward.

Advantageously, the lighting module is a strip light, and the end is provided with an insertion hole that cooperates with the plug connector.

Advantageously, the top surface of the strip light is provided with a magnet for fixing.

A laminate comprises a board body, a support arm and a shelf lighting system.

A shelf comprises a shelf pillar provided with a power supply rail and a laminate.

Advantageously, the surface on one side of the shelf pillar is provided with a plurality of support arm fixing holes arranged along the length direction, and the root of the support arm is provided with a insert block that cooperates with the support arm fixing hole, and when fitting the insert block with the support arm fixing hole, the power taking head and the power supply rail are mated to achieve electrical connection.

Technical Effect of the Invention

The shelf lighting system, a laminate equipped with the lighting system and a shelf thereto of the present invention integrate the power taking module of the shelf lighting system onto the support arm of the shelf, so that the installation of the power taking module can be realized while completing the installation of the laminate at the same time, the lighting module can be quickly installed, which simplifies the entire lamp installation process, improves the installation efficiency, and has no exposed wires, making the whole more beautiful.

BRIEF DESCRIPTION OF THE DRAWINGS

The following describes embodiments of the present invention with reference to the accompanying drawings, in which.

DETAILED DESCRIPTION OF THE INVENTION

Figure 1:
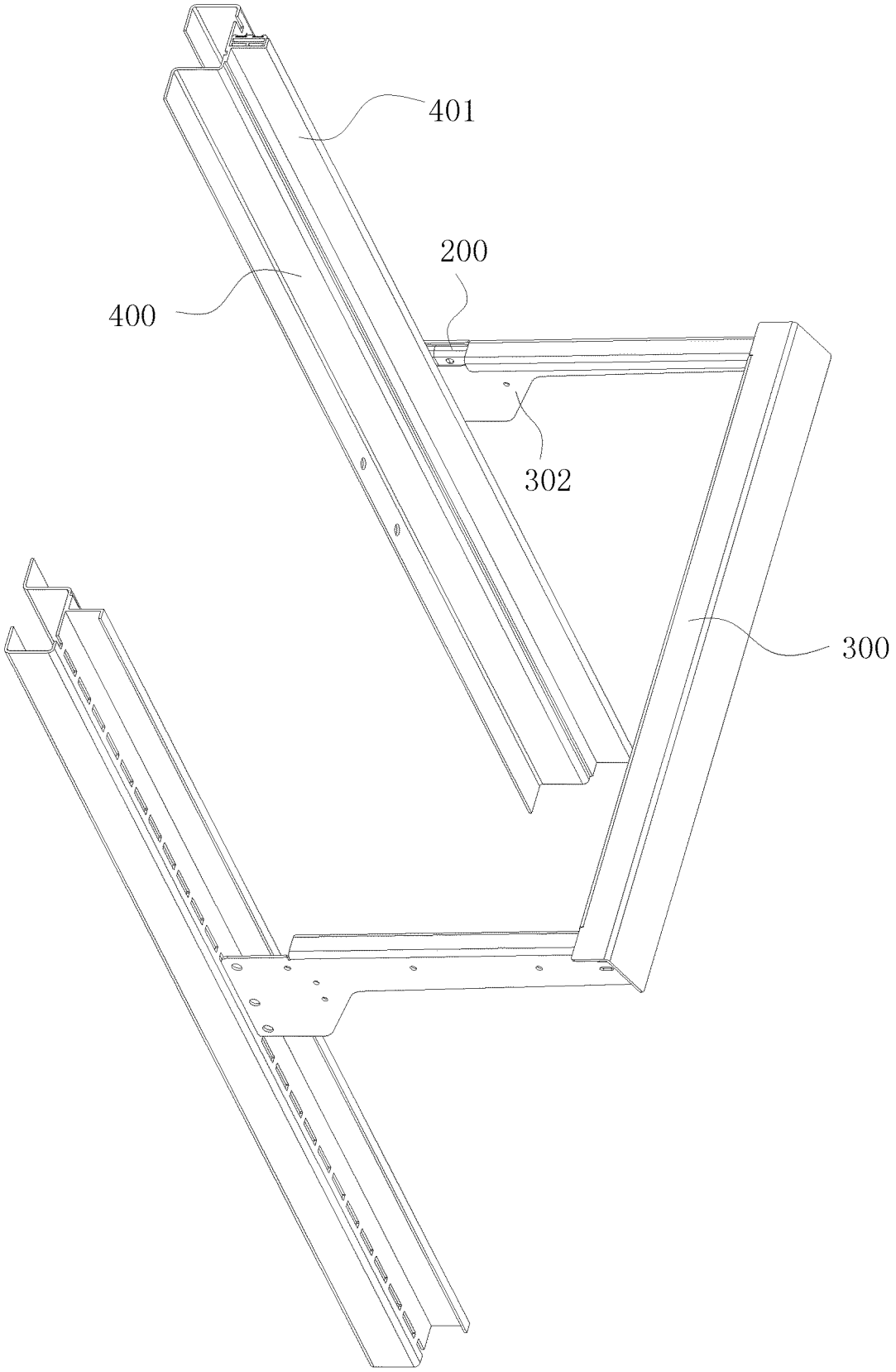
FIG. 1 is a schematic diagram of a three-dimensional structure of the shelf of Embodiment 1.
Figure 2:
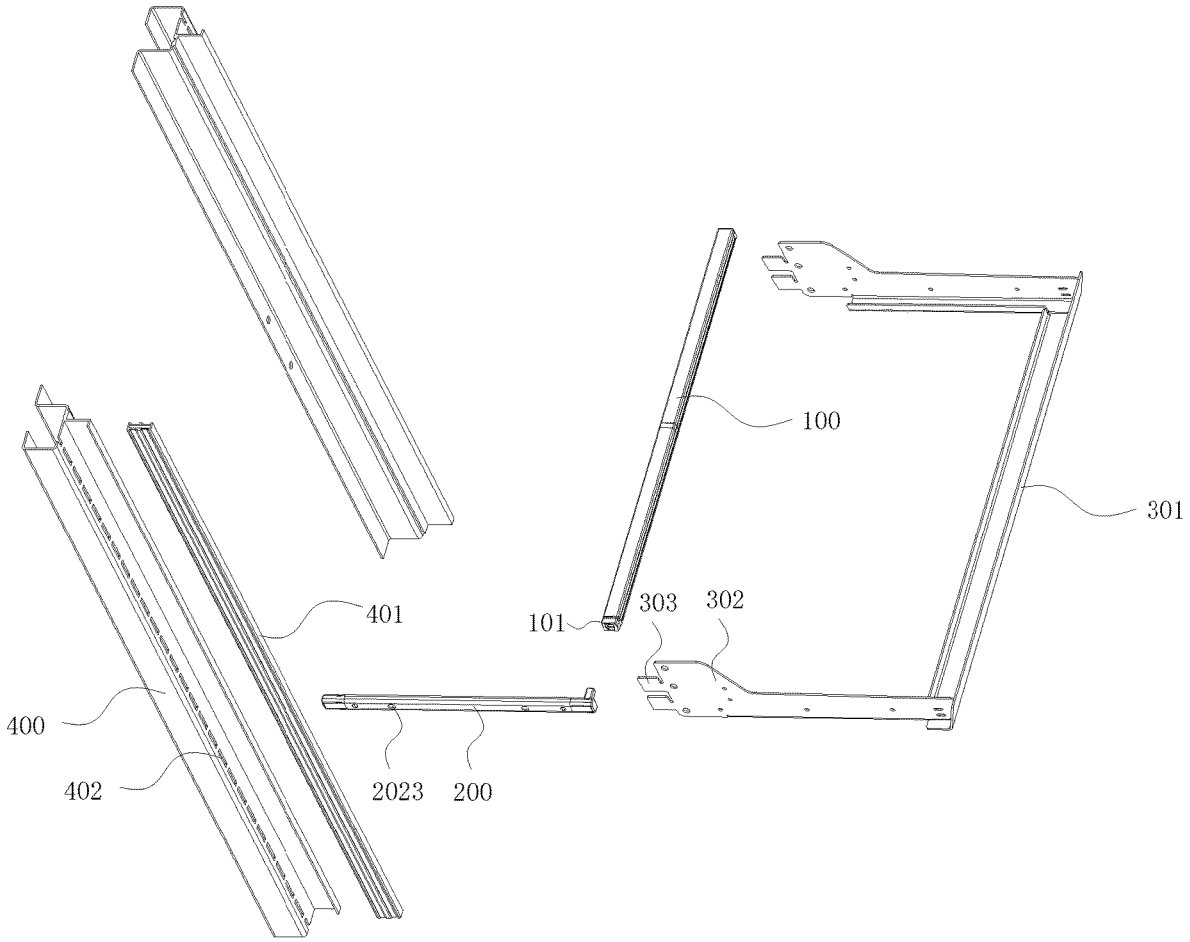
FIG. 2 is a schematic diagram of the explosion structure of the shelf of Embodiment 1.
Figure 3:
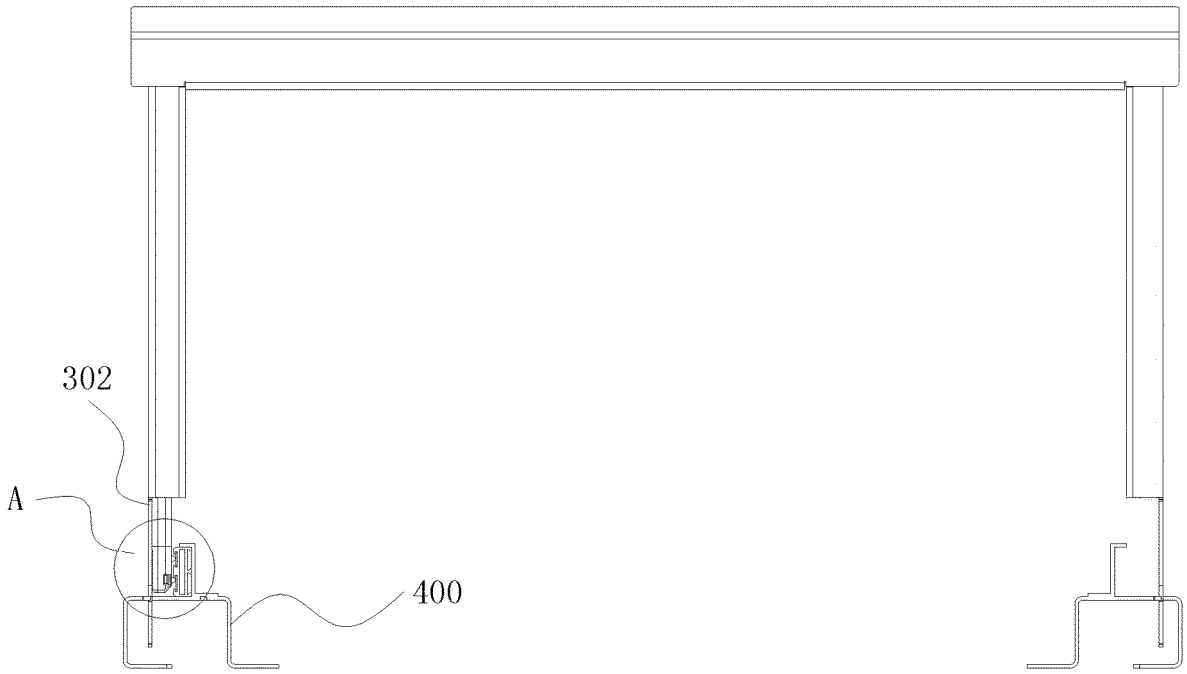
FIG. 3 is a schematic structural view of the shelf of Embodiment 1 at a top view.
Figure 4:
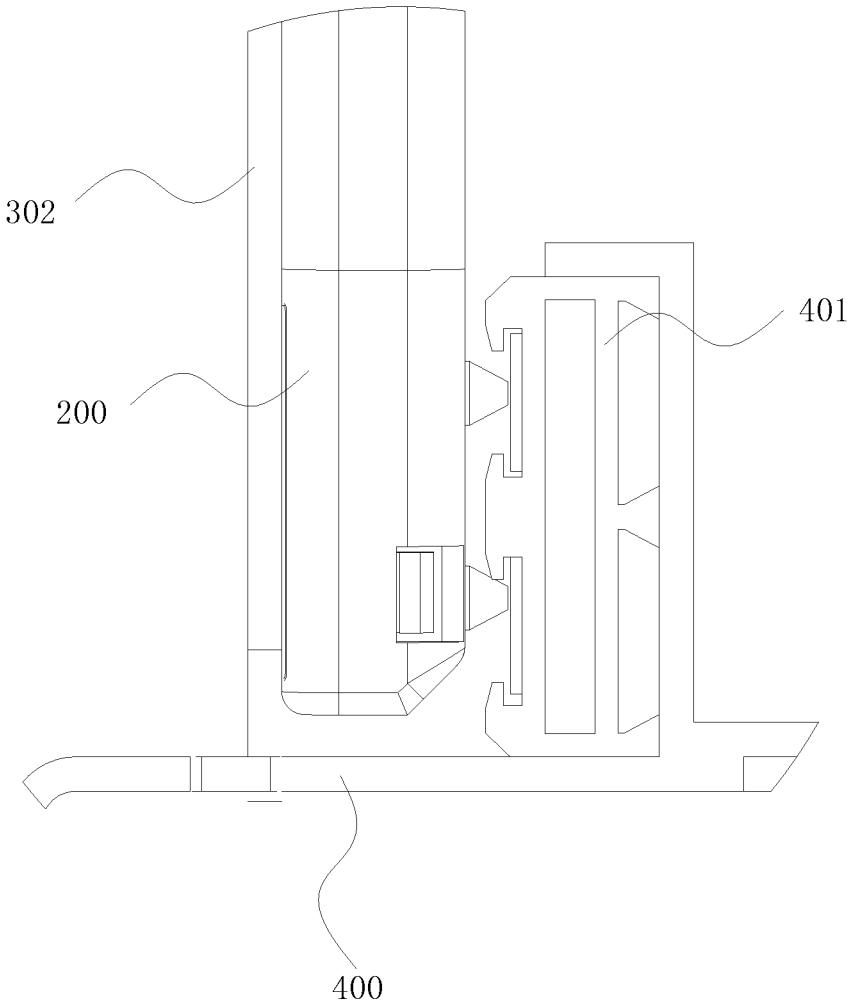
FIG. 4 is an enlarged schematic structural view of part A in FIG. 3.
Figure 5:
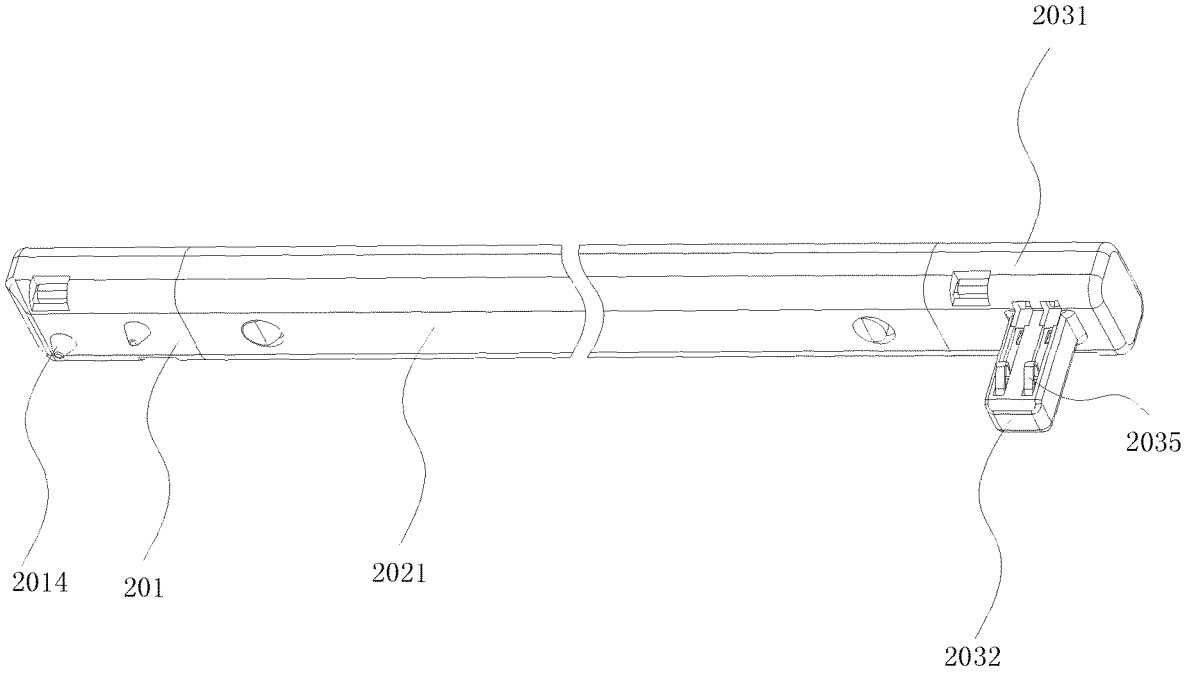
FIG. 5 is a schematic structural diagram of the power taking module of Embodiment 1.
Figure 6:
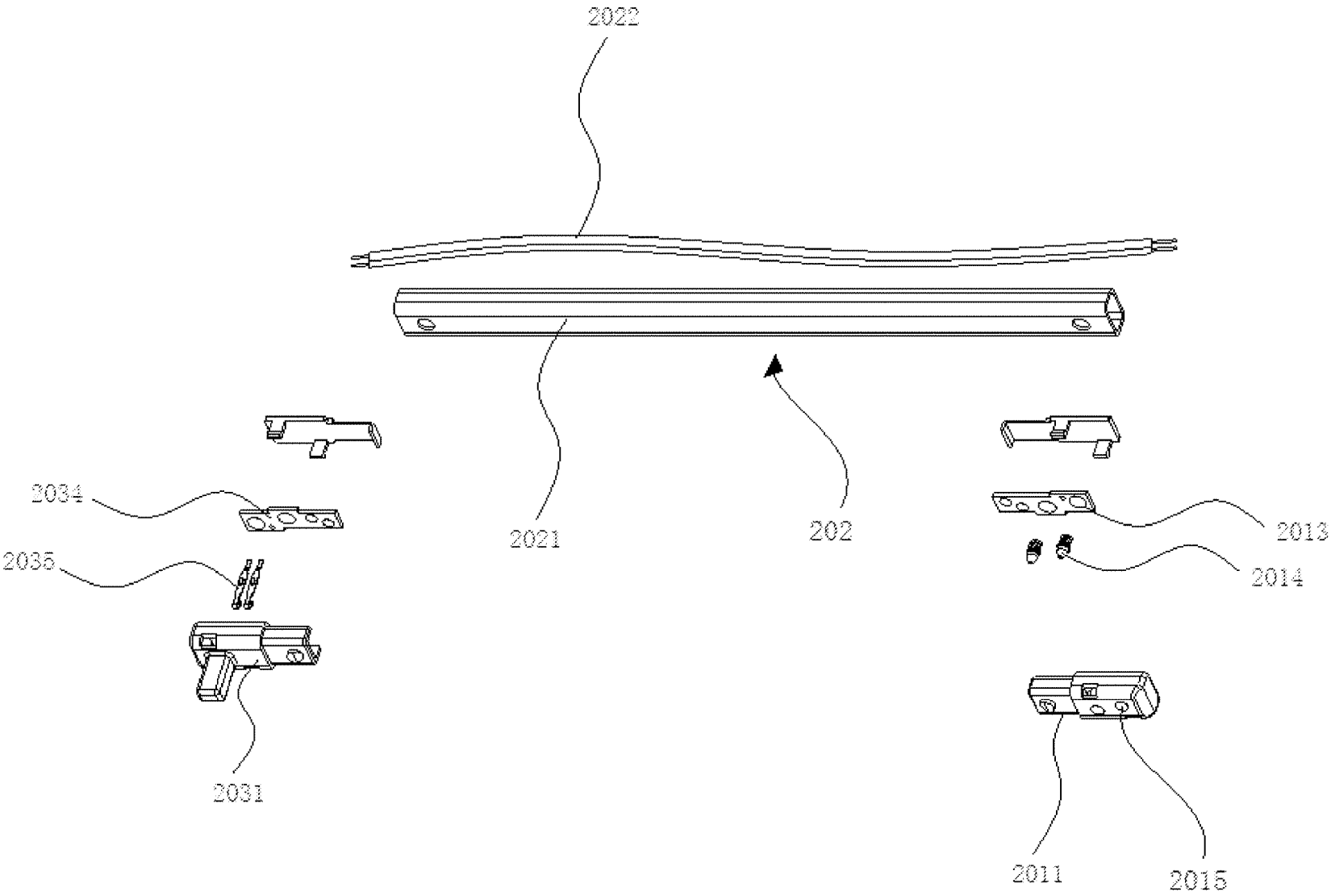
FIG. 6 is a schematic diagram of the explosion structure of the power taking module of Embodiment 1.
Figure 7:
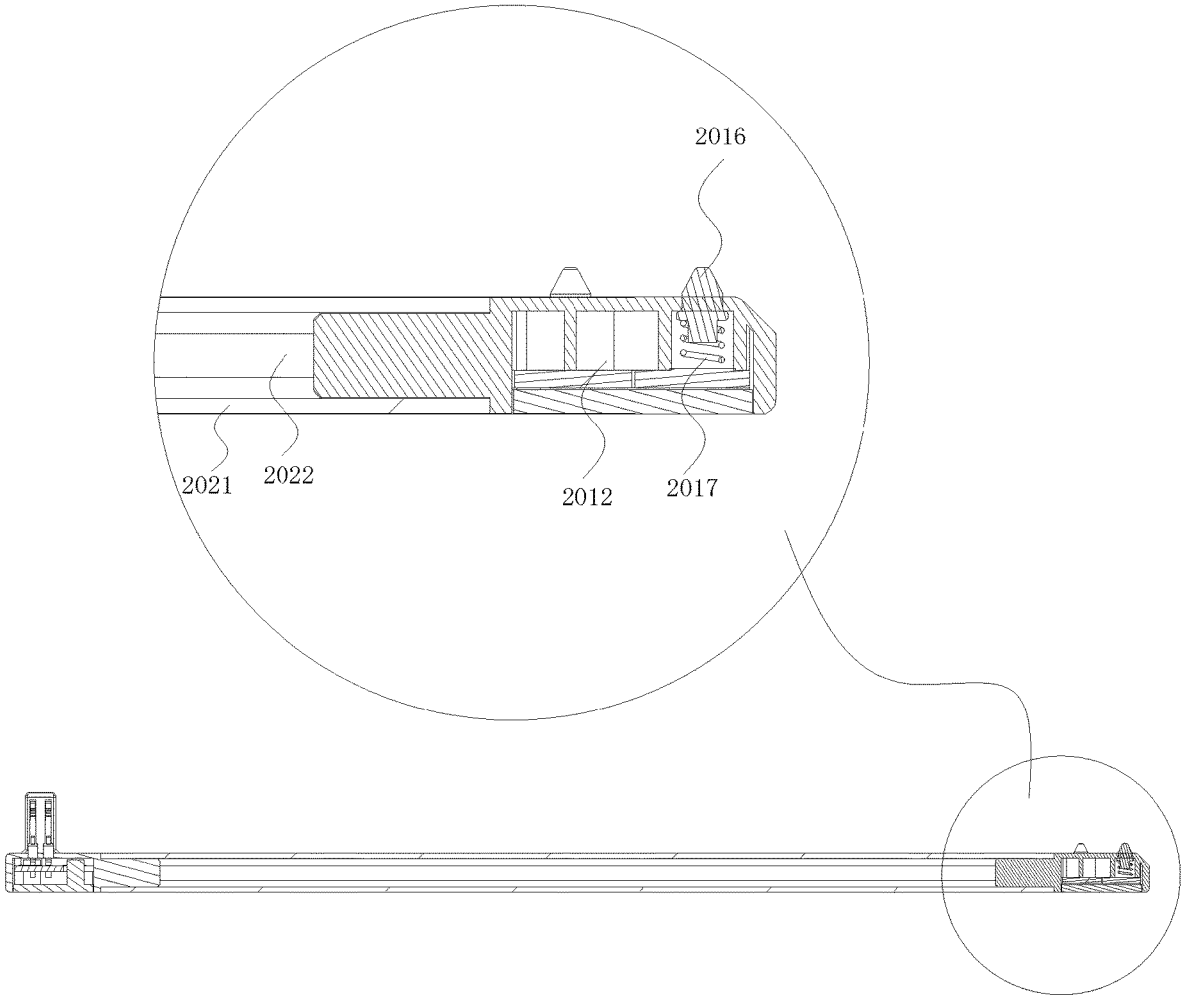
FIG. 7 is a schematic cross-sectional structural view of the power taking module of Embodiment 1.
Figure 8:
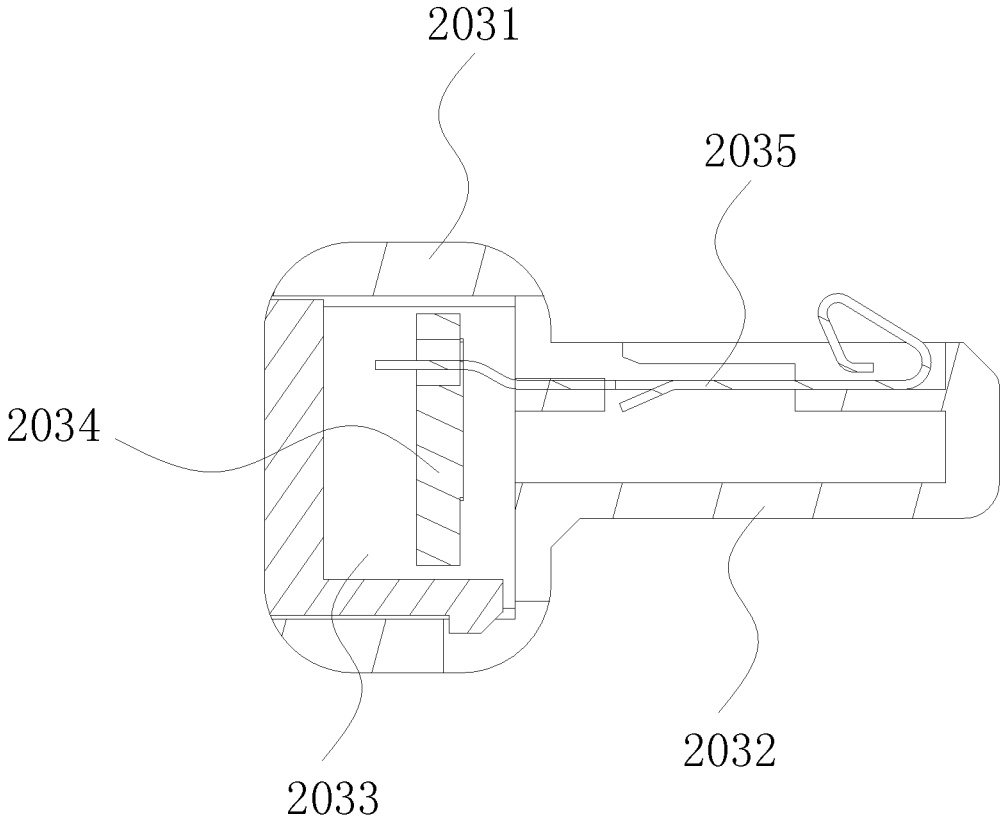
FIG. 8 is a schematic cross-sectional structural view of the power taking module of Embodiment 1 at a plug connector.
Figure 9:
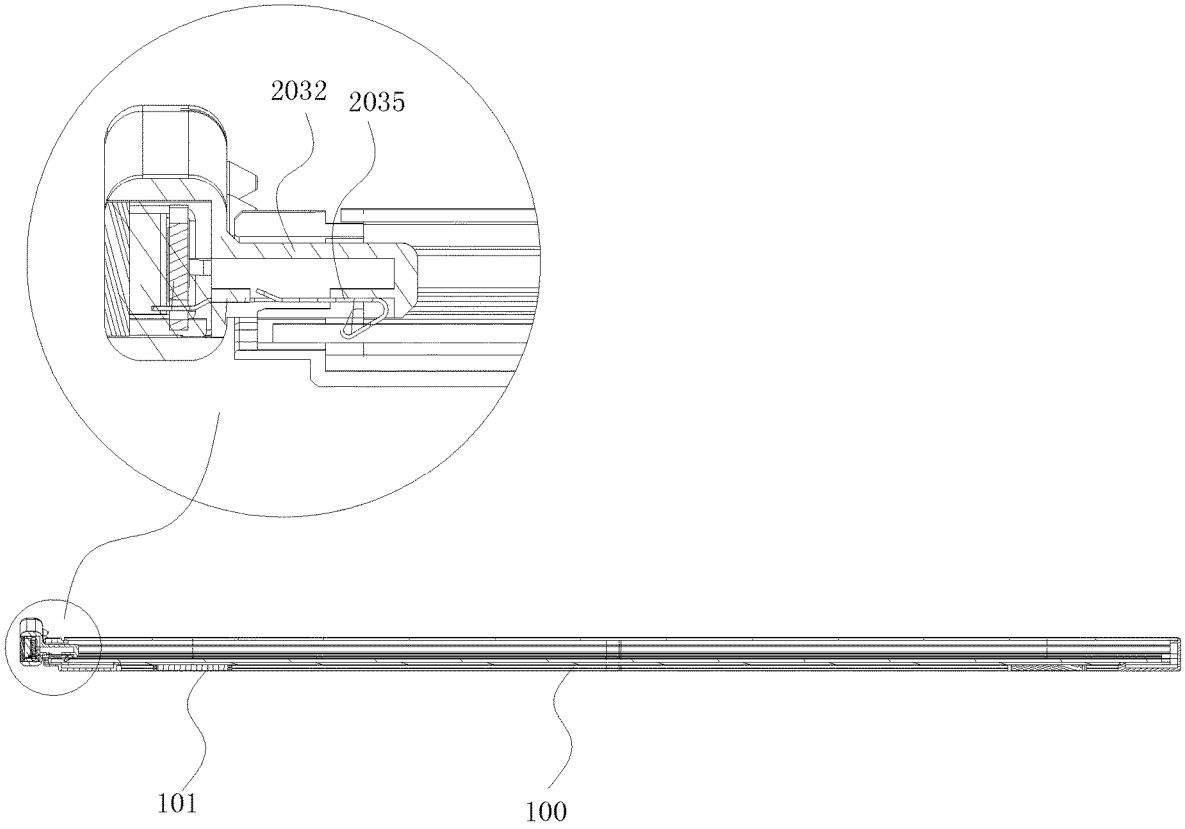
FIG. 9 is a schematic cross-sectional structural view of the power taking module and the lighting module of Embodiment 1 after plug-in installation.

Hereinafter, specific embodiments of the present invention will be described in further detail based on the drawings. It should be understood that the description of the embodiments of the present invention is not intended to limit the protection scope of the present invention.

Embodiment 1

As shown in FIGS. 1 to 9, the shelf of this embodiment includes a laminate 300 and a shelf pillar 400 provided with a power supply rail 401.

The shelf generally includes a shelf pillar and a laminate 300 mounted on the shelf pillar 400 (There are no plates, just frames in figures), which are the two most important and basic parts of the shelf. Sometimes there are also backplanes, panels and other structures, which are not the focus of the invention in this application and are not described here.

The laminate 300 is used for placing objects. In many cases, the objects on the laminate 300 need to be illuminated by lamps to improve the display effect. In order to facilitate the installation of the lamp, in this embodiment, the laminate 300 includes a board body, a support arm 302 and a shelf lighting system.

In this embodiment, the shelf lighting system is integrated in the shelf. During the installation of the shelf, the installation of the lamp and its power supply system is completed, which is very convenient.

In this embodiment, the shelf lighting system includes a lighting module 100 and a power taking module 200. The lighting module 100 is disposed on the lower surface of the laminate 300 near the outer edge 301 of the laminate. The installation of lamps in this position, on the one hand, can achieve good lighting effect; on the other hand, can have a good anti-glare effect, because the laminate here will generally bend down to form a rib, which can be used to install labels and so on.

In this embodiment, the power taking module 200 includes a power taking head 201, a strip-shaped conductive member 202 and a plug connector 203. The power taking head 201 is fixed on the inner side of the support arm 302 near the shelf pillar 400, and is electrically connected with the power supply rail 401 on the shelf pillar 400 to realize electrical connection; The strip-shaped conductive member 202 is located inside the support arm 302, and one end is electrically connected with the power taking head 201; the plug connector 203 is fixed at one end of the inner side of the support arm 302 near the outer edge 301 of the laminate, and is electrically connected to the other end of the strip-shaped conductive member 202 and provides power for the lighting module 100.

The power supply rail 401 is fixed on the outside of the shelf pillar 400 or installed in the hollow shelf pillar 400.

The power taking module 200 of the above structure is integrated on the support arm 302. After the support arm 302 is fixed to the shelf pillar 400, the lighting module 100 is directly installed on the lower surface of the laminate 300 near the outer edge 301 of the laminate to realize power supply, which is convenient and fast. It not only simplifies the steps of lamp installation, but also makes the shelf appearance tidier.

The strip-shaped conductive member 202 can directly use flexible wires. In order to facilitate installation and protect the wires, in this embodiment, the strip-shaped conductive member 202 includes a strip-shaped housing 2021 and a lead wire 2022 disposed in the strip-shaped housing 2021. The strip-shaped housing 2021 can not only play a role of fixing, but also protect the flexible lead wire 2022. In this embodiment, the strip-shaped housing 2021 is also provided with a fastening hole 2023 for fixing. The support arm 302 can be provided with a fixing hole matched with the fastening hole 2023, and the fixing hole is fixedly connected to the fastening hole 2023 through a convenient plastic buckle which is convenient for disassembly, wherein the plastic buckle passes through the fixing hole to connect with the fastening hole 2023, achieving the fixation of the strip-shaped housing 2021.

The power taking head 201 takes power from the power supply rail 401, and there are many ways to achieve cooperation. It can manually fix the power taking head 201 to the power supply rail 401 to achieve taking electricity. The key is to electrically connect the electrical contacts to the surface of the rail. In this embodiment, the power taking head 201 adopts a plug-in manner. When the support arm 302 is fixed on the shelf pillar 400, the matching of the power taking head 201 and the power supply rail 401 is completed at the same time. The surface on one side of the shelf pillar 400 is provided with a plurality of support arm fixing holes 402 arranged along the length direction, and the root of the support arm 302 is provided with an insert block 303 that cooperates with the support arm fixing hole. When fitting the insert block 303 with the support arm fixing hole 402, the power taking head 201 and the power supply rail 401 are mated to achieve electrical connection, and the number of the insert blocks 303 can be set as needed. In this embodiment, two insert blocks 303 are provided.

In order to achieve the above operation, in this embodiment, the power taking head 201 includes a first installation seat 2011, a first installation cavity 2012, a first conductive circuit board 2013, and an elastic contact 2014. The first installation seat 2011 is fixedly connected to one end of the strip-shaped housing 2021; the first installation cavity 2012 is provided on the first installation seat 2011 and communicates with the strip-shaped housing 2021; the first conductive circuit board 2013 it is arranged in the first installation cavity 2012 and is electrically connected with the lead wire 2022; the elastic contact 2014 is telescopically arranged on the first installation seat 2011, and one end extends into the first installation cavity 2012 and the first conductive circuit board 2013, and the other end extends out of the first installation cavity 2012. In order to facilitate manufacturing, the first installation seat 2011 is made by assembling the front and back covers.

In order to improve the reliability of the electrical connection, in this embodiment, the direction of expansion and contraction of the elastic contact 2014 is perpendicular to the plane where the inside of the support arm 302 lies. Specifically, the first installation seat 2011 is provided with a mounting hole 2015 for accommodating the elastic contact 2014. The elastic contact 2014 includes an elastic column 2016 provided in the mounting hole 2015 and an conductive springs 2017 arranged between the first conductive circuit board 2013 and the elastic column 2016.

The plug connector 203 is used to connect a lighting module, that is, a lamp. In order to achieve quick connection, in this embodiment, the plug connector 203 includes a second installation seat 2031, a second installation cavity 2033, a second conductive circuit board 2034, and a strip-shaped contact piece 2035. Wherein, the second installation seat 2031 is fixedly connected to the other end of the strip-shaped housing 2021 and with a plug 2032 protruding outward; the second installation cavity 2033 is provided on the second installation seat 2031 and is in communicate with the strip-shaped housing 2031; the second conductive circuit board 2034 is disposed in the second installation cavity 2033 and is electrically connected to the lead wire 2022; the strip-shaped contact piece 2035 is fixed on the plug 2032, and one end extends into the second installation cavity 2033 and electrically connects to the second conductive circuit board 2034, and the other end is bent outward to form an elastic contact. The second installation seat 2031 is formed by assembling the front and back covers.

Since the conduction of the positive and negative electrodes is needed in the circuit to achieve power supply, the electrical connection parts in this application are both positive and negative, including the positive and negative power supply bars in the power supply rail 401, and the elastic contact 2014 is provided with positive and negative, the strip-shaped contact piece 2035 is also provided with two positive and negative, the above-mentioned settings are described in the prior art, and will not be repeated here.

The convex direction of the plug 2032 determines the direction of insertion. To facilitate the installation of the lighting module 100 of this embodiment, the insertion direction of the plug connector 203 is perpendicular to the plane where the inside of the support arm 302 is located. The lighting module 100 can adopt various shapes of lamps. In the application of shelves, strip lights are most commonly used, and the illumination range is relatively large. The lighting module 100 is a strip light, and the end is provided with a insertion hole 101 that cooperates with the plug connector 203. The insertion hole 101 is provided with contacts for electrical connection with the elastic contacts. In this embodiment, the opening of the insertion hole 101 is arranged outward along the length direction of the strip lamp.

The cross section of the plug 2032 can be a square, a circle, or other shapes, and the insertion hole 101 has a shape matching that shape.

In order to facilitate fixing the strip lamp, in this embodiment, the top surface of the strip lamp is provided with a magnet 102 for fixing. Since the laminate is generally made of steel material, the strip lamp of this embodiment can be installed by adsorption, which further simplifies the structure and installation steps.

Embodiment 2

Figure 10:
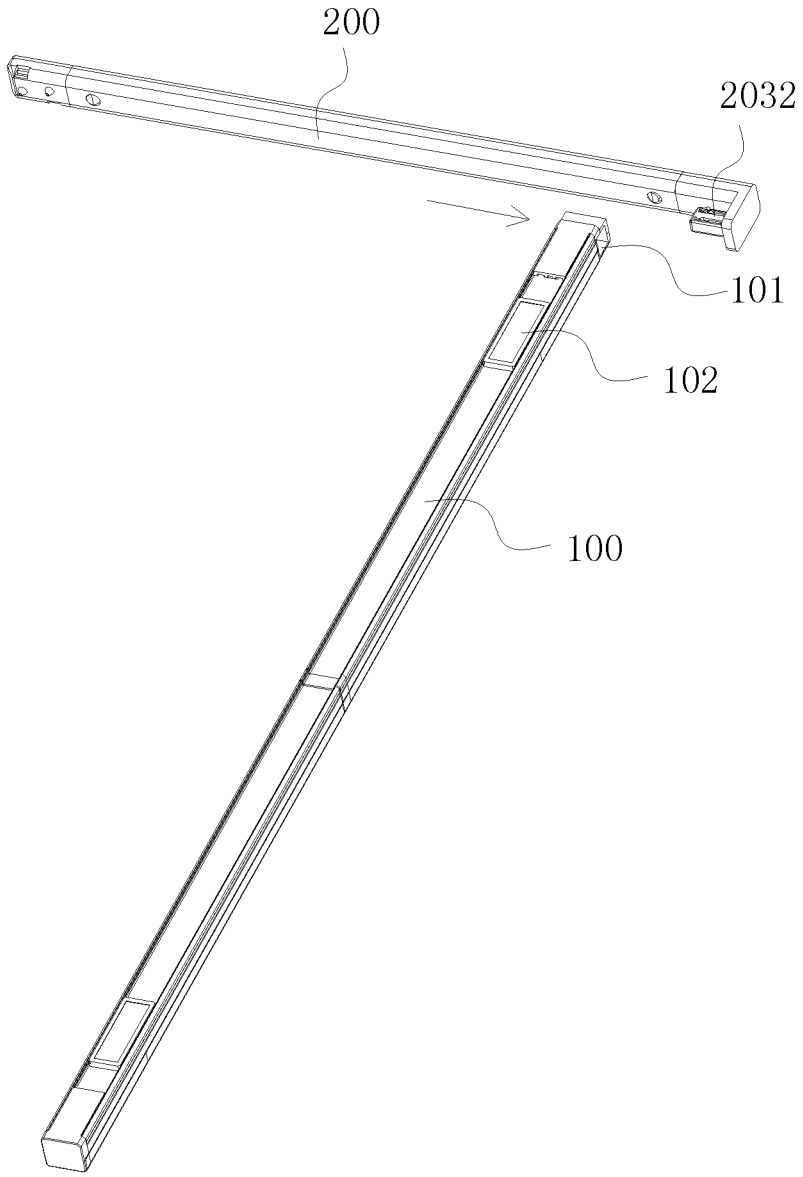
FIG. 10 is a schematic structural diagram of a plugging process of the power taking module and the lighting module of Embodiment 2.
Figure 11:
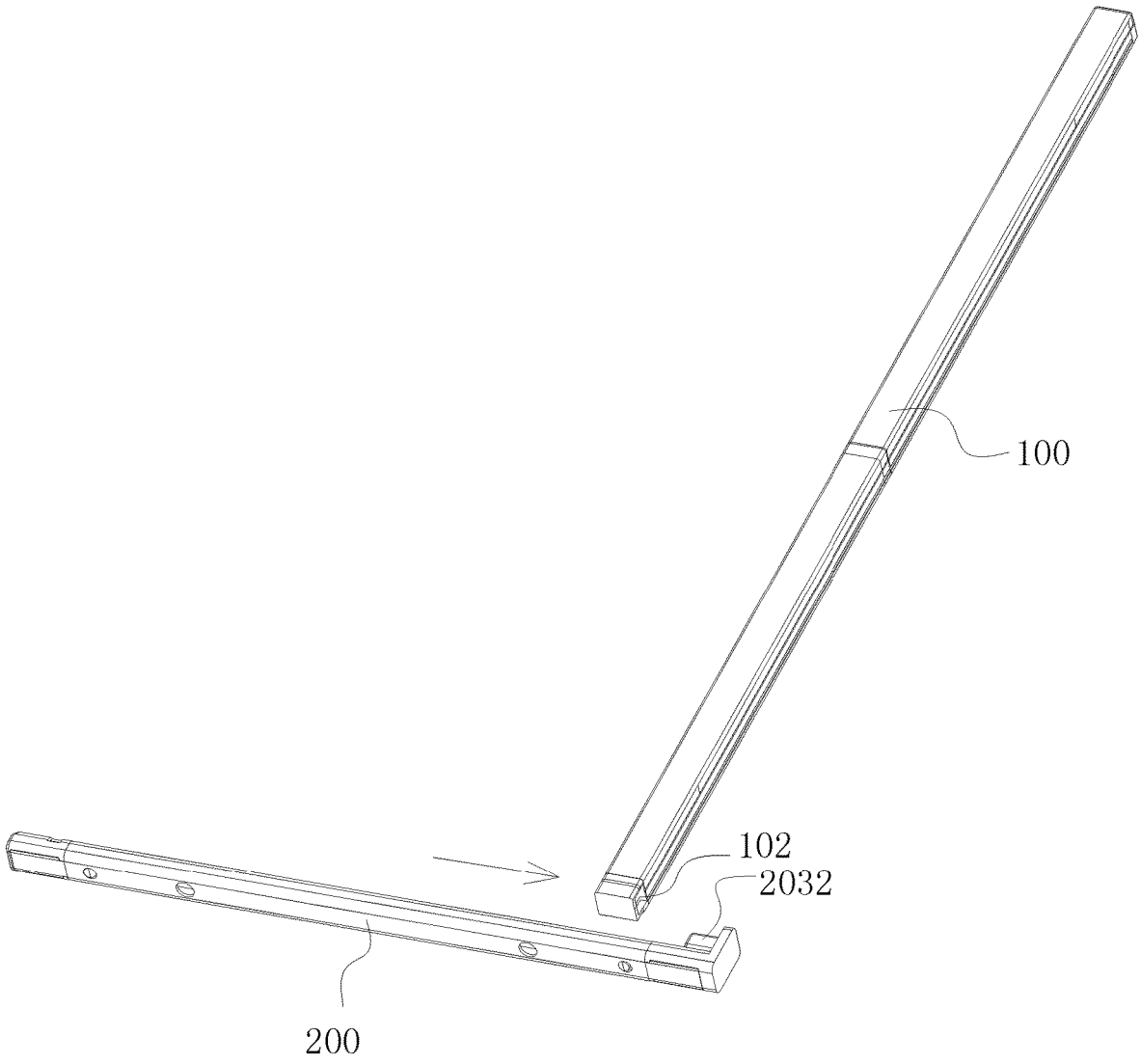
FIG. 11 is a schematic structural diagram of a plugging process of the power taking module and the lighting module of Embodiment 2.

As shown in FIGS. 10 and 11, in this embodiment, except that the orientation of the plug 2032 is different from that of embodiment 1, the remaining structure is the same as that of embodiment 1. In this embodiment, the plug 2032 is oriented towards the shelf pillar 400 and the insertion direction is parallel to the plane where the support arm 302 is located, so that the horizontal insertion and installation of the strip lamp can be realized, which is more convenient. The arrow in the figure shows the direction of insertion.

Embodiment 3

Figure 12:
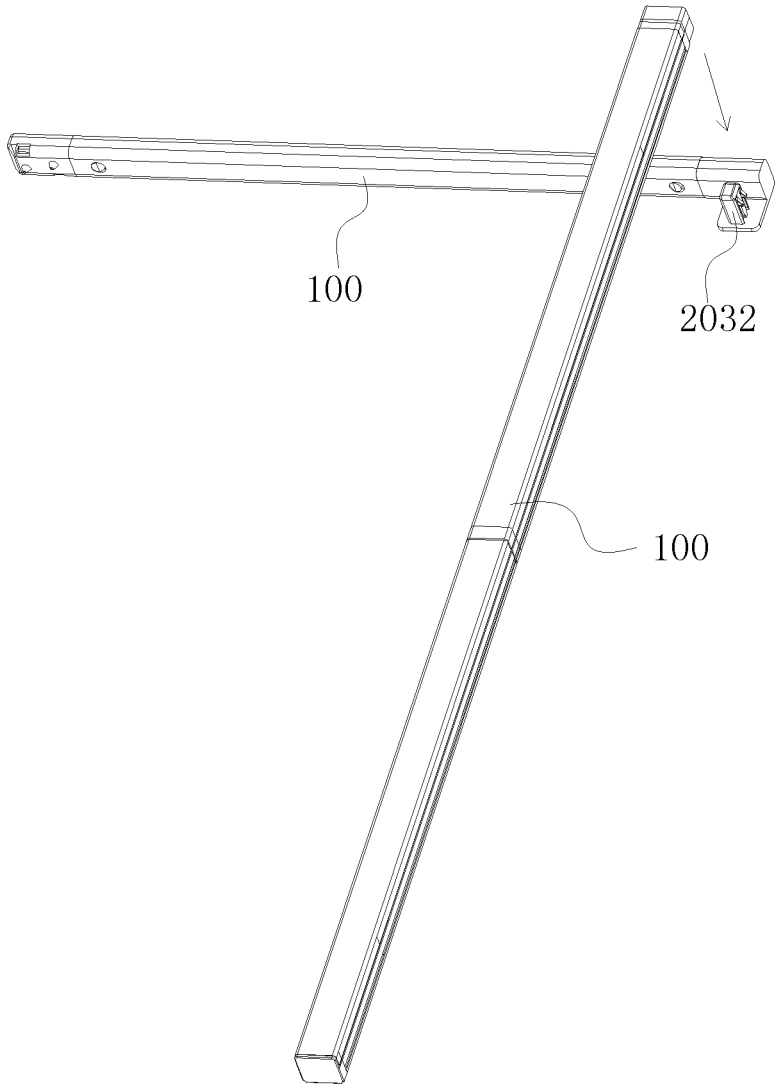
FIG. 12 is a schematic structural diagram of a plug-in process of the power taking module and the lighting module of Embodiment 3.
Figure 13:
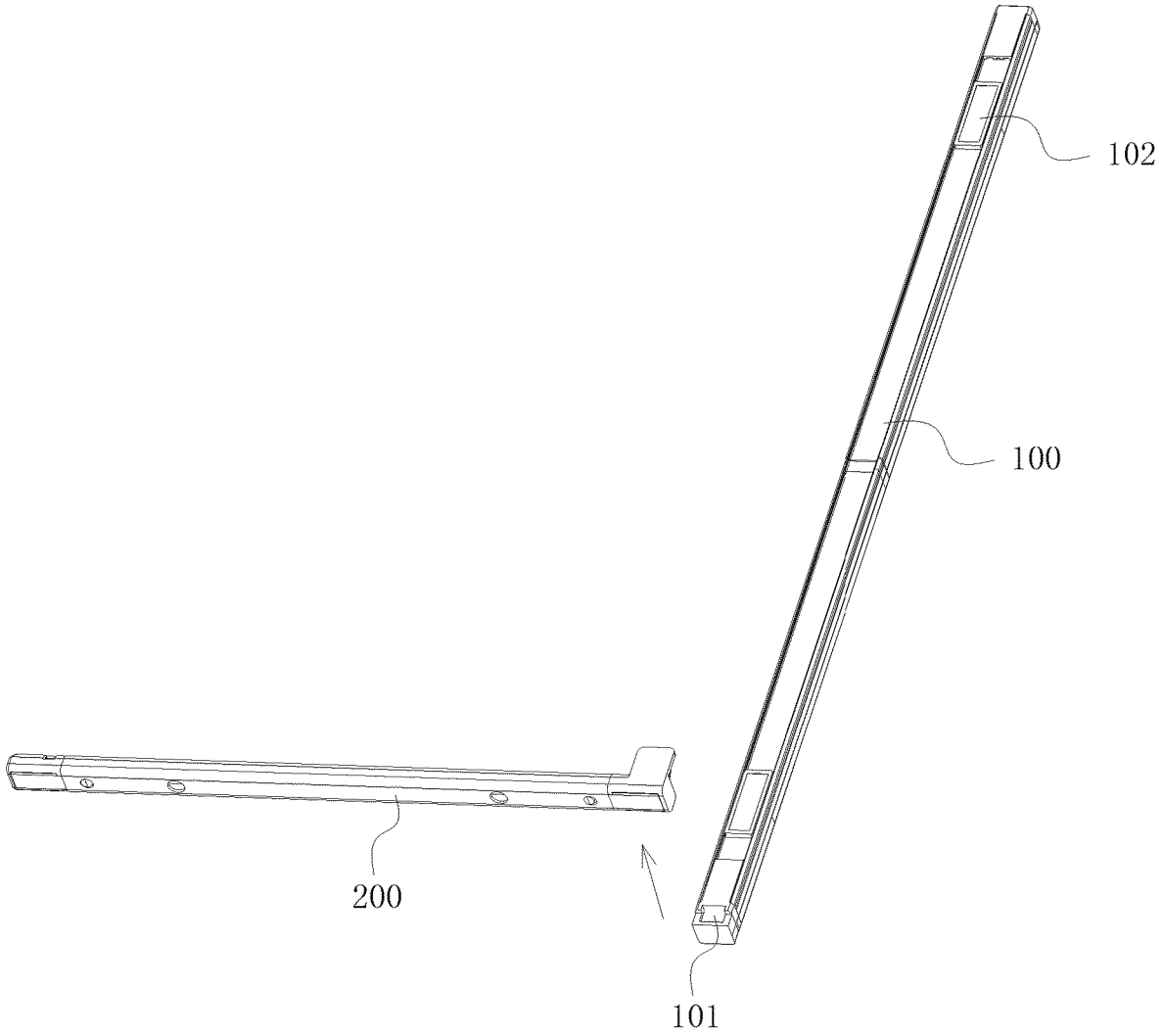
FIG. 13 is a schematic structural diagram of a plugging process of the power taking module and the lighting module of Embodiment 3.

As shown in FIGS. 12 and 13, in this embodiment, except that the orientation of the plug 2032 is different from that of embodiment 1, the remaining structure is the same as that of embodiment 1. In this embodiment, the plug 2032 is vertically downward, so that the vertical insertion and installation of the strip lamp can be realized, which is more convenient. The arrow in the figure shows the direction of insertion.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A shelf lighting system, comprising a lighting module and a power taking module, characterized in that the lighting module is disposed on the lower surface of a laminate near the outer edge of the laminate, the power taking module comprises:

a power taking head, fixed on the inner side of a support arm near a shelf pillar, and connected with a power supply rail on the shelf pillar to achieve electrical connection;

a strip-shaped conductive member, located inside the support arm, and one end is electrically connected to the power taking head;

a plug connector, fixed at one end of the inner side of the support arm close to the outer edge of the laminate, and electrically connected to the other end of the strip-shaped conductive member and providing power for the lighting module;

wherein the power taking head comprises:

a first installation seat, fixedly connected to one end of a strip-shaped housing;

a first installation cavity, which is provided on the first installation seat and communicates with the strip-shaped housing;

a first conductive circuit board, disposed in the first installation cavity, and electrically connected to the lead wire;

and an elastic contact, telescopically arranged on the first installation seat, and one end extends into the first installation cavity and the first conductive circuit board, and the other end extends out of the first installation cavity.

2. The shelf lighting system as claimed in claim 1, wherein the strip-shaped conductive member comprises a strip-shaped housing and a lead wire disposed in the strip-shaped housing.

3. The shelf lighting system as claimed in claim 1, wherein the direction of expansion and contraction of the elastic contact is perpendicular to the plane where the inside of the support arm lies.

4. The shelf lighting system as claimed in claim 1, wherein the first installation seat is provided with a mounting hole for accommodating an elastic contact, the elastic contact comprises an elastic column arranged in the mounting hole and an conductive springs arranged between the first conductive circuit board and the elastic column.

5. The shelf lighting system as claimed in claim 1, wherein the lighting module is a strip light, and the end is provided with an insertion hole that cooperates with the plug connector.

6. A laminate, comprising a board body, a support arm and a shelf lighting system as claimed in claim 1.

7. The shelf lighting system as claimed in claim 2, wherein the strip-shaped housing is provided with a fastening hole for fixing.

8. The shelf lighting system as claimed in claim 2, wherein the plug connector comprises:

a second installation seat, fixedly connected to the other end of the strip-shaped housing, and being with a plug that protrudes outward;

a second installation cavity, which is provided on the second installation seat and communicates with the strip-shaped housing;

a second conductive circuit board, disposed in the second installation cavity, and electrically connected to the lead wire;

and a strip-shaped contact piece, fixed on the plug, and one end extends into the second installation cavity and electrically connected to the second conductive circuit board, and the other end is bent outward to form elastic contacts.

9. The shelf lighting system as claimed in claim 5, wherein the top surface of the strip light is provided with a magnet for fixing.

10. A shelf characterized by comprising a shelf pillar provided with a power supply rail and a laminate as claimed in claim 6.

11. The shelf lighting system as claimed in claim 8, wherein the insertion direction of the plug is perpendicular to the plane where the inside of the support arm is located.

12. The shelf lighting system as claimed in claim 8, wherein the plug is oriented towards the shelf pillar and the insertion direction is parallel to the plane where the support arm is located.

13. The shelf lighting system as claimed in claim 8, wherein the plug is vertically downward.

14. The shelf as claimed in claim 10, wherein the surface on one side of the shelf pillar is provided with a plurality of support arm fixing holes arranged along the length direction, and a root of the support arm is provided with a insert block that cooperates with the support arm fixing hole, and when fitting the insert block with the support arm fixing hole, the power taking head and the power supply rail are mated to achieve electrical connection.

* * * * *